US011692395B1

(12) United States Patent
Bullock

(10) Patent No.: US 11,692,395 B1
(45) Date of Patent: Jul. 4, 2023

(54) LADDER BLOCKING DEVICE

(71) Applicant: Robert Wade Bullock, Williston, FL (US)

(72) Inventor: Robert Wade Bullock, Williston, FL (US)

( * ) Notice: Subject to any disclaimer, the term of this patent is extended or adjusted under 35 U.S.C. 154(b) by 417 days.

(21) Appl. No.: 16/801,064

(22) Filed: Feb. 25, 2020

(51) Int. Cl.
*E06C 7/00* (2006.01)
*E06C 1/06* (2006.01)

(52) U.S. Cl.
CPC ..... *E06C 7/006* (2013.01); *E06C 1/06* (2013.01)

(58) Field of Classification Search
CPC ... E06C 7/006; E06C 7/08; E06C 7/00; E06C 7/50; E06C 1/06; A01M 29/30; E04H 4/144; E04H 4/06
See application file for complete search history.

(56) References Cited

U.S. PATENT DOCUMENTS 1,454,750 A * 5/1923 George ..... E06C 7/165 182/120
2,880,829 A * 4/1959 Watkins ..... E06C 7/006 182/47
2,888,716 A * 6/1959 Kaufmann ..... A01M 29/30 52/101
3,422,923 A * 1/1969 Lund ..... E06C 7/14 182/20
3,968,857 A * 7/1976 Bryan ..... E06C 9/02 182/47
4,126,206 A * 11/1978 Becnel ..... E06C 7/006 182/230
4,524,848 A * 6/1985 Russo ..... E06C 7/185 182/92
4,579,197 A * 4/1986 Spurling ..... E06C 7/006 182/20
4,664,225 A * 5/1987 Coutier ..... E06C 7/185 182/116
5,421,428 A * 6/1995 Ingles ..... E06C 7/14 182/230
5,441,126 A * 8/1995 Orrick ..... E06C 7/006 182/230
5,832,755 A * 11/1998 Crilly ..... E06C 7/006 224/323
6,775,950 B2 * 8/2004 Donoho ..... A01M 29/32 119/713
7,243,465 B2 * 7/2007 Donoho ..... B29C 45/0001 119/713

(Continued)

FOREIGN PATENT DOCUMENTS

GB 2424441 9/2006

OTHER PUBLICATIONS

O.S.H.A. standard 29 C.F.R. § 1910.23—Ladders, p. 125 (Year: 2020).*

*Primary Examiner* — Brian D Mattei
*Assistant Examiner* — Kathleen M. McFarland

(57) ABSTRACT

The invention presented is a ladder blocking device attached to a ladder to prevent unauthorized use of the ladder. In one embodiment, the device includes a plurality of prongs that extends from a support system that holds the device onto the ladder. In one alternate embodiment, a shield rests over and is supported by the prongs. In second alternate embodiment, the shield is attached directly to the support system without the presence of the prongs.

26 Claims, 13 Drawing Sheets

(56) References Cited

U.S. PATENT DOCUMENTS

| | | | | |
|---|---|---|---|---|
| 7,717,231 | B2 * | 5/2010 | Horton | E06C 7/006 182/106 |
| 8,479,457 | B2 * | 7/2013 | Donoho | A01M 29/32 52/101 |
| 8,997,929 | B1 * | 4/2015 | Todd | E06C 7/182 182/115 |
| 9,681,656 | B1 * | 6/2017 | Minerva | E06C 7/006 |
| 2002/0092704 | A1 * | 7/2002 | Climo | E06C 7/006 182/106 |
| 2006/0076188 | A1 * | 4/2006 | Horton | E06C 7/006 182/106 |
| 2008/0029340 | A1 * | 2/2008 | White | E06C 7/006 182/106 |
| 2010/0236865 | A1 * | 9/2010 | Crowton | E06C 1/26 182/129 |
| 2012/0097481 | A1 * | 4/2012 | Schienke | E06C 1/06 182/107 |
| 2012/0125714 | A1 * | 5/2012 | Allam | E06C 7/006 182/129 |
| 2012/0312635 | A1 * | 12/2012 | Randolph | E06C 7/006 182/129 |
| 2016/0160562 | A1 * | 6/2016 | Cheng | E06C 7/006 4/504 |
| 2016/0186493 | A1 * | 6/2016 | Young | E06C 1/34 182/230 |
| 2017/0101821 | A1 * | 4/2017 | Shattuck | E04H 4/144 |
| 2020/0224692 | A1 * | 7/2020 | Hsia | F16B 7/22 |
| 2020/0318431 | A1 * | 10/2020 | DeLoe | E06C 1/04 |

* cited by examiner

LADDER BLOCKING DEVICE

FIELD OF THE INVENTION

The field of the invention relates generally to security devices and safety devices, more specifically to devices to prevent climbing a ladder, and still more specifically to portable and removable ladder security devices.

BACKGROUND OF THE INVENTION

Ladders are often left unattended at worksites, towers, such as water storage towers, hunting stands and other locations as it is often more convenient to leave them in place rather than remove them after each use, possibly transport them off site and then put them in place again for the next use. Moreover, as in the case of towers and other permanent structures, ladders are often fixed in place and are not transportable. Whether fixed in place by convenience or necessity, ladders can provide a temptation to unauthorized persons to climb them to gain illegal or unsanctioned access to a building, hunting stand, or other structure.

U.S. Pat. No. 9,410,373 to Randolph discloses a plurality of sections of compressible material that are wrapped around the stringers of a ladder to cover the ladder rungs. Although the rungs of a ladder are covered, there are slits or openings between the sections which may allow someone to climb up the ladder placing their feet either onto the rungs themselves or resting their weight on the sections themselves. U.S. Patent Application Publication No. 2010/0236865 to Crowton, et al. discloses a blocking device attached to and extending horizontally from the ladder thereby blocking access to the upper portion of the ladder. The blocking device includes a pivotable plate that pivots away from the ladder to allow access. However, because the blocking device disclosed in the Randolph publication pivots into the user on the blocked ladder, it creates a safety hazard as it forces the user to pivot the blocking plate from below the plate so that the user is hanging onto the ladder with only one hand.

The prior art is replete with examples of ladder blocking devices in which the primary component is a covering such as a sheet, shell, and/or other covering device attached to the ladder thereby preventing a user from climbing by removing access to the rungs. However, there are several disadvantages in such devices in that they are often clumsy to carry and they block only the lower rungs of the ladder. In addition, the attachments of the rung covers to the ladder are almost by necessity easily reached by an unauthorized user making them relatively easy to remove, overcome or bypass.

Therefore, it can be seen that there is a need in the art for a ladder blocking device that is difficult to bypass and easily carried to the location of the ladder.

SUMMARY OF THE INVENTION

The present invention broadly comprises a ladder blocking device including a first support wherein the at least one first support ranges at least from a first stringer of the ladder to at least a second stringer of the ladder; a first plurality of prongs, each one of the plurality of prongs extending from the first support; and an attachment means to attach the first support to the ladder. In a preferred embodiment, the present invention further includes a second support wherein the second support includes a second plurality of prongs having an attachment means to attach directly or indirectly to the ladder and wherein the second support is connected to the first support. In an alternate embodiment, one or both of the first and second plurality of prongs supports a shield.

The present invention also broadly comprises a first support wherein said at least one first support ranges at least from a first stringer of said ladder to at least a second stringer of said ladder; a first shield fixedly attached to said first support; and, an attachment means to attach said first support to said ladder. In a preferred embodiment, the invention further includes a second shield fixedly attached to a second support; wherein the first support is connected to the second support to form a shield unit.

The present invention also broadly comprises a ladder assembly that includes: a ladder including a pair of stringers and a plurality of rungs extending between and fixedly attached to each one of the pair of stringers, the pair of stringers arranged in a parallel manner; and, a ladder blocking device including: a ladder including a pair of stringers and a plurality of rungs extending between and fixedly attached to each one of said pair of stringers, said pair of stringers arranged in a parallel manner; and, a ladder blocking device that includes a support assembly wherein a first blocking support and a second blocking support each range at least from a first stringer of said ladder to at least a second stringer of said ladder; and, an attachment means to attach said support assembly to said ladder. The ladder blocking device may include a locking means. In an alternate embodiment, the ladder assembly may further include a first shield fixedly attached to the first blocking support and a second shield fixedly attached to the second blocking support. In a different embodiment, the ladder assembly may further include a first plurality of prongs attached to the first blocking support and a second plurality of prongs attached to the second blocking support. Each of the first plurality of prongs may support a first shield and the second plurality of prongs may support a second shield.

An object of the invention is to provide a portable apparatus to block use of a ladder.

A second object of the invention is to prevent accidents caused by unsafe use of a ladder.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
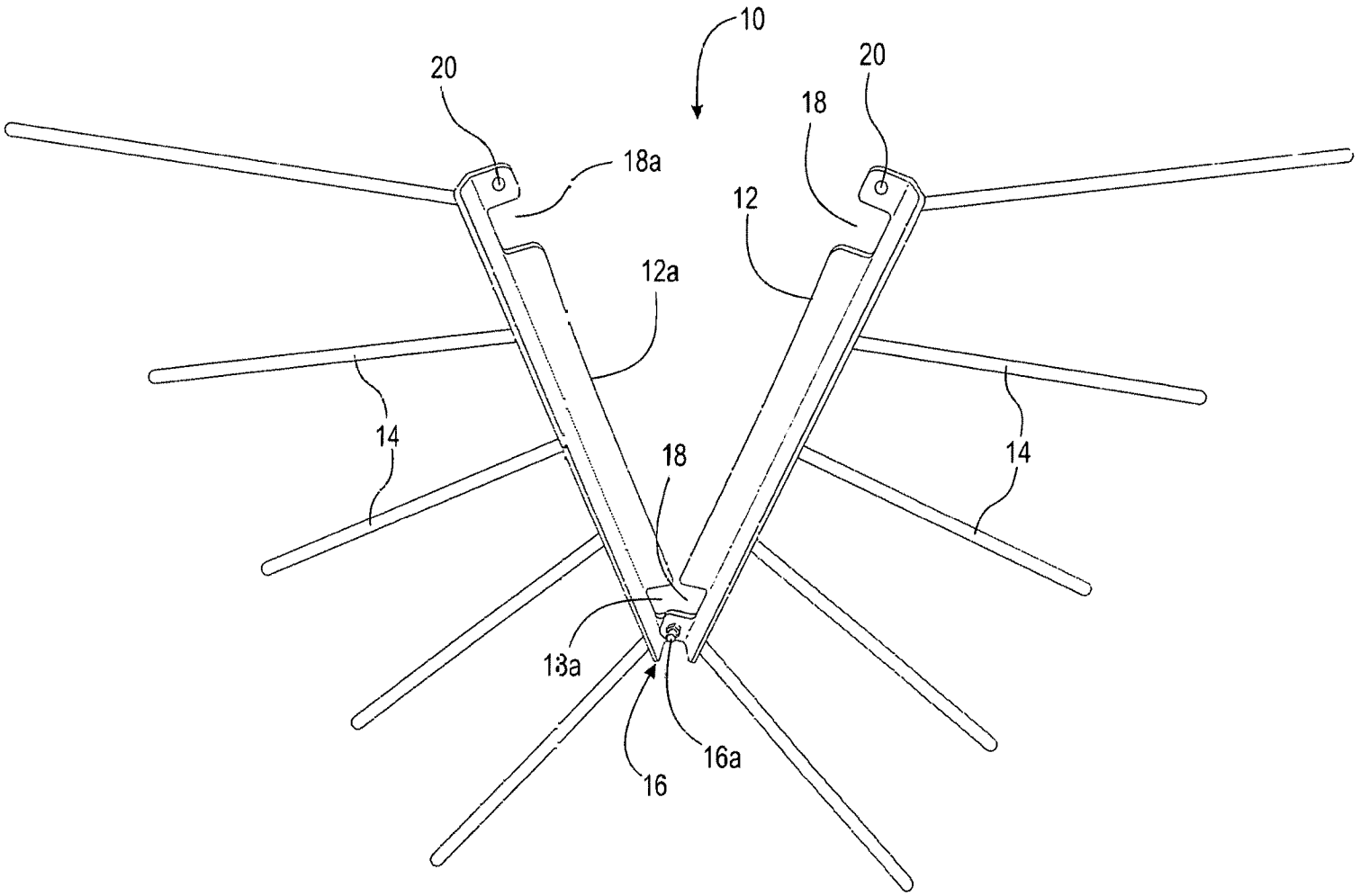
FIG. 1 is a top view of one embodiment of the ladder blocking device of the present invention.

Adverting to the drawings, FIG. 1 is a top view of one embodiment of the ladder blocking device 10 ("device 10") of the present invention. Device 10 includes first support 12 (support 12") which holds a plurality of prongs 14 that extend from first support 12 at an angle in relation to support 12. In an alternate embodiment, device 10 also comprises second support 12*a* ("support 12*a*") (collectively "supports 12"). As seen at least in FIG. 1, support 12 and support 12*a* may be joined to form one unit support 12. In the embodiment shown, the two components of support 12 may be pivotably joined at pivot point 16. In the drawing shown, bolt 16*a* forms the pivotable joint. In other embodiments, the pivotable joint may be a hinge or other joint well known to persons skilled in the art. Preferably, notches 18 are formed in supports 12 to enable each support 12 and 12*a* to fit around the stringers 32 of the blocked ladder 30 (not shown in FIG. 1). Supports 12 and 12*a* may be attached directly to ladder 30 directly such as by welding or bolting one or more of supports 12 to ladder 30 or indirectly such as by resting device 10 on a ladder rung while in a closed position with notches 18 fitted around the stringers of ladder 30 thereby holding device 10 on ladder 30.

Figure 2:
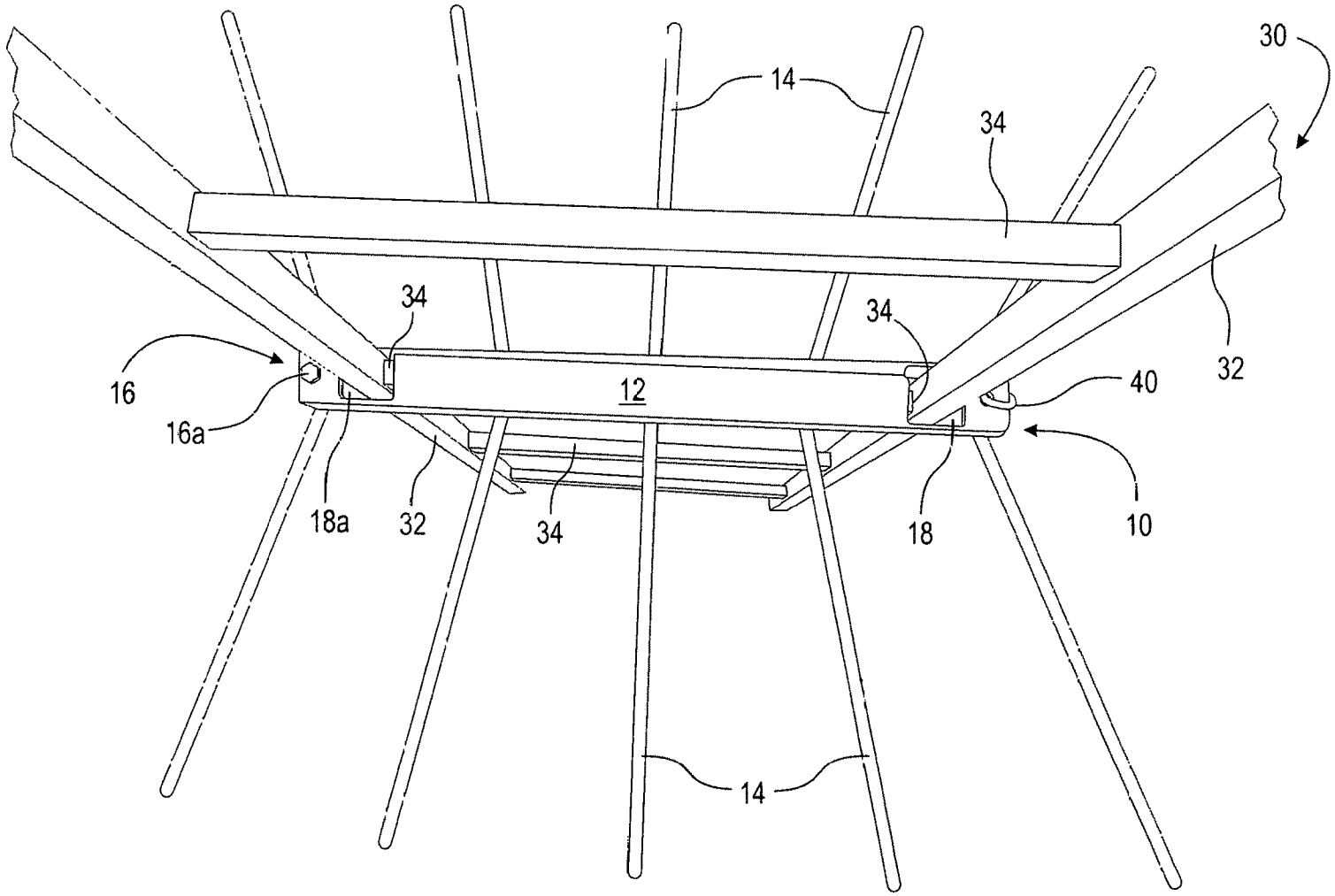
FIG. 2 is a top view depicting the blocking device attached to and supported by a ladder.
Figure 3:
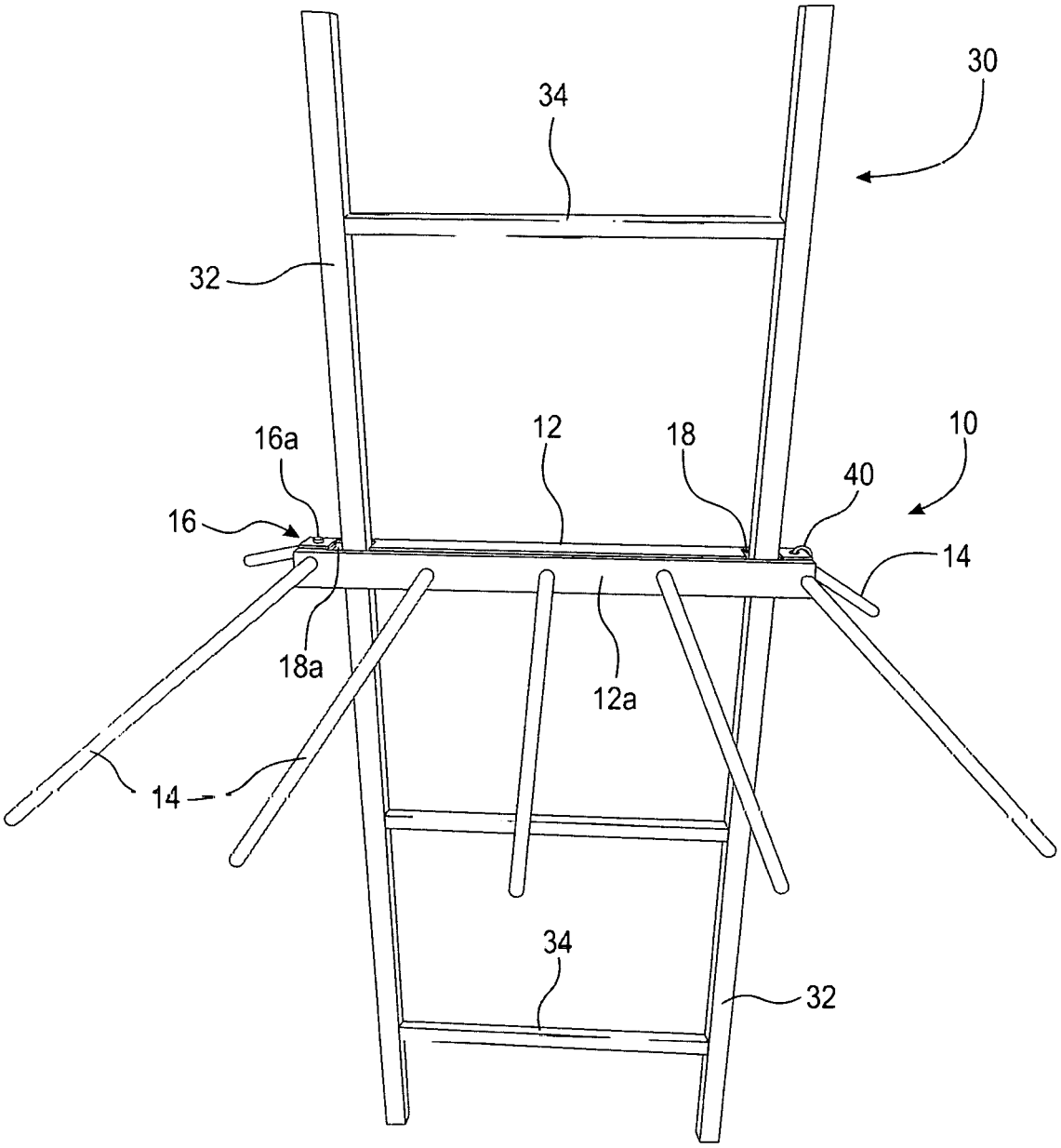
FIG. 3 is a front view of the blocking device attached to the ladder.

FIG. 2 is a top view depicting device 10 attached to and supported by ladder 30. Device 10 is supported by one of the plurality of rungs 34 and extends to each of the two parallel stringers 32 of ladder 30. Notches 18 fit around each stringer 32 to hold device 10 in position on ladder 30. Prongs 14 extend separately outwardly and downwardly from support 12 and support 12*a* (not seen in FIG. 2) so that both sides of ladder 30 are blocked from an unauthorized user. Although two supports 12 are shown in FIG. 2, persons having skill in the art will recognize that only a first support 12 may be needed to block use of ladder 30 if the ladder is positioned close to a building or other structure so that there is insufficient space for a user to climb up the unblocked side of ladder 30. FIG. 3 is a front view of blocking device 10 attached to ladder 30 showing how support 12 and support 12*a* overlap each other on the same rung 34.

Figure 4:
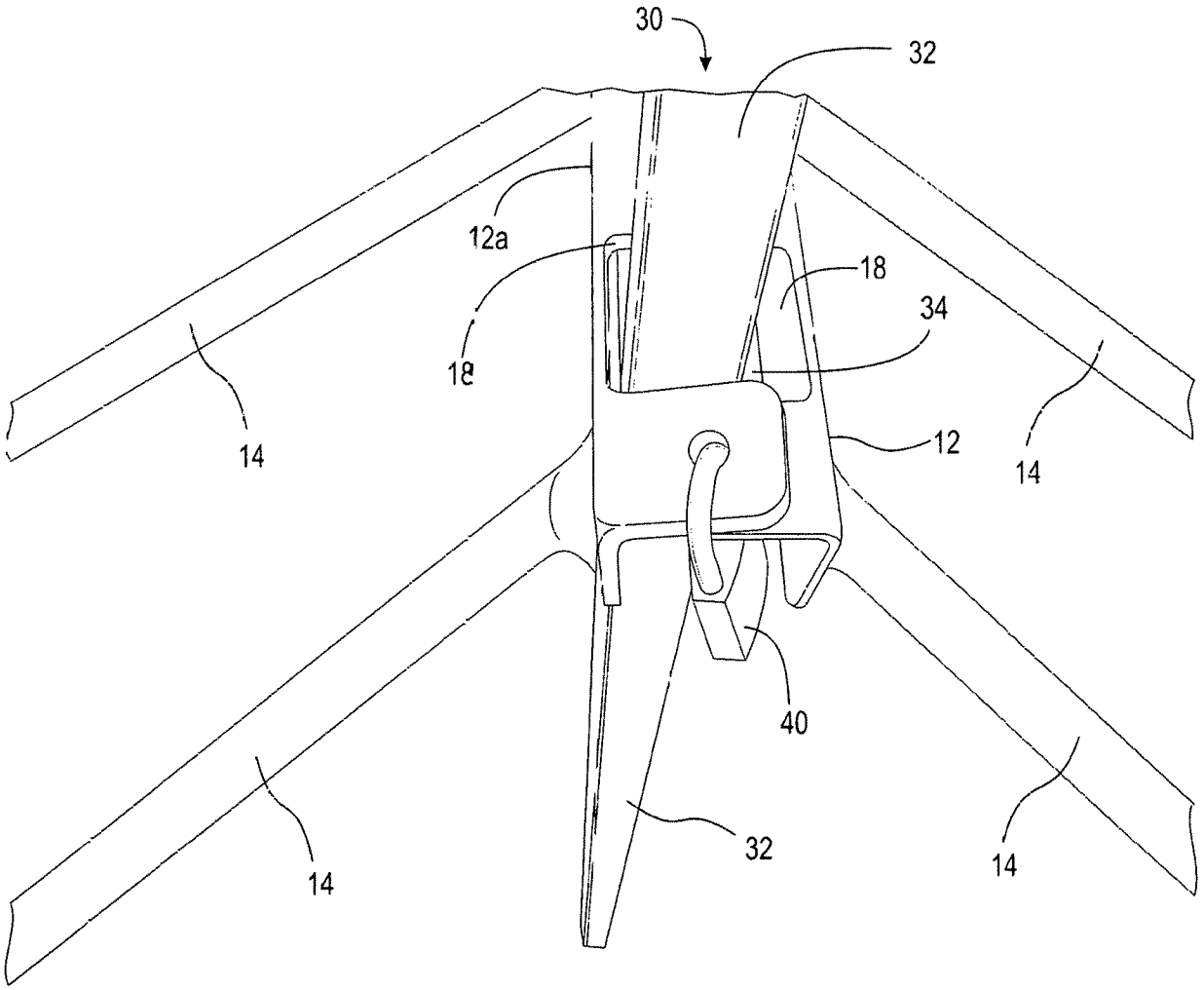
FIG. 4 is a partial side perspective view of the combined ladder and blocking device assembly showing a locking mechanism holding the supports together.

FIG. 4 is a partial side perspective view of the combined ladder 30 blocking device 10 assembly showing a lock 40 holding supports 12 together. Although a padlock 40 is shown, persons of skill in the art will recognize that other locking mechanisms, such as but not limited to, combination locks or a locked cable, may be used to lock supports 12 together.

Figure 5:
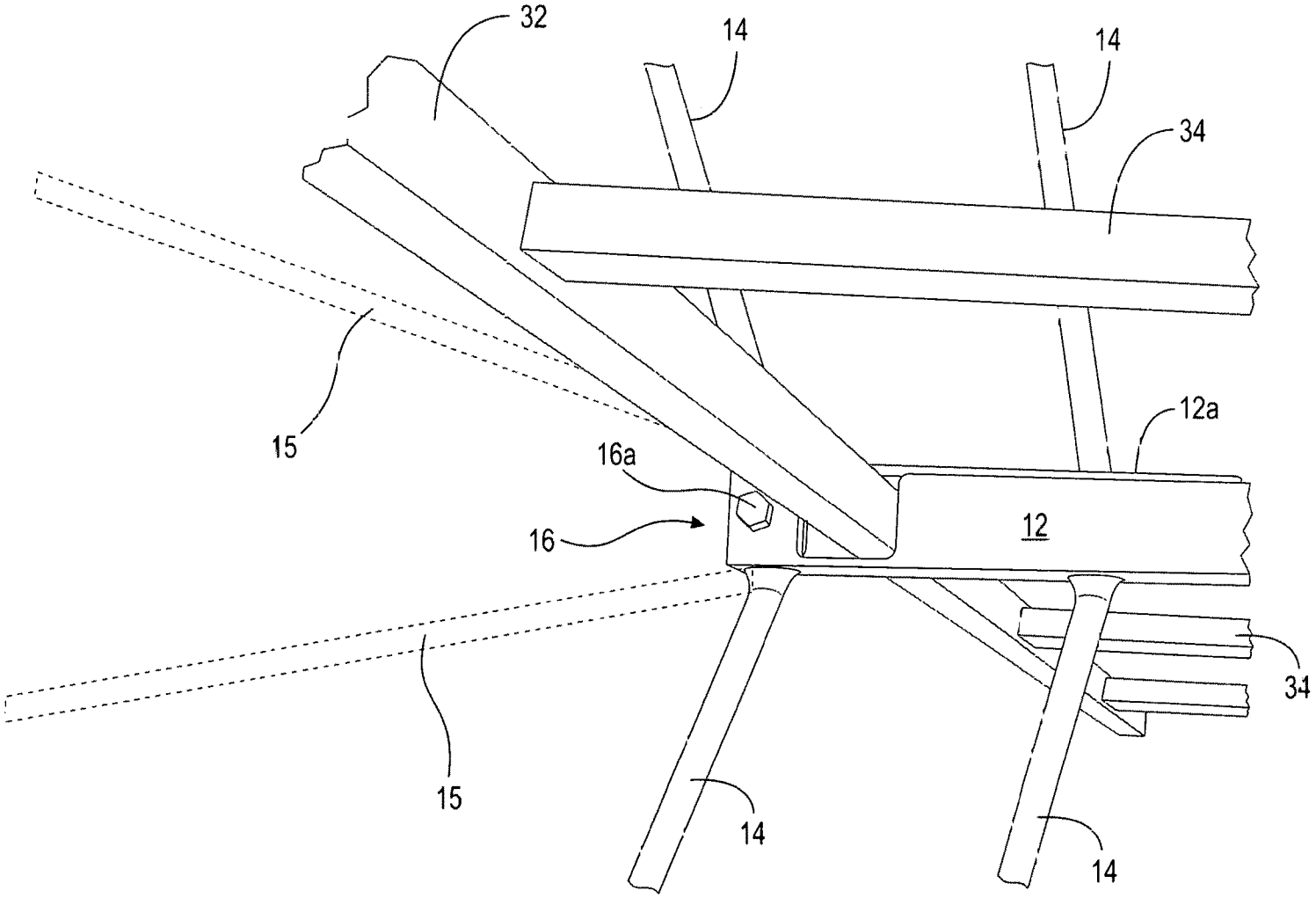
FIG. 5 is an enlarged partial top view of the invention in which each support of the blocking device includes additional prongs that extend toward the side of stringer.

FIG. 5 is an enlarged partial top view of the invention in which each of support 12 and support 12*a* includes additional prongs 15 that extend toward the side of stringer 32 so as to obstruct users from bypassing device 10 by climbing outside one of the stringers 32. In the embodiment shown, side prongs 15 are shown in shaded lines as attached to, such as by using welds, supports 12 and/or support 12*a*. In this embodiment, blocking device 10 may be easily carried to the ladder 30 even with side prongs 15 included on each of supports 12 and 12*a*.

Figure 6:
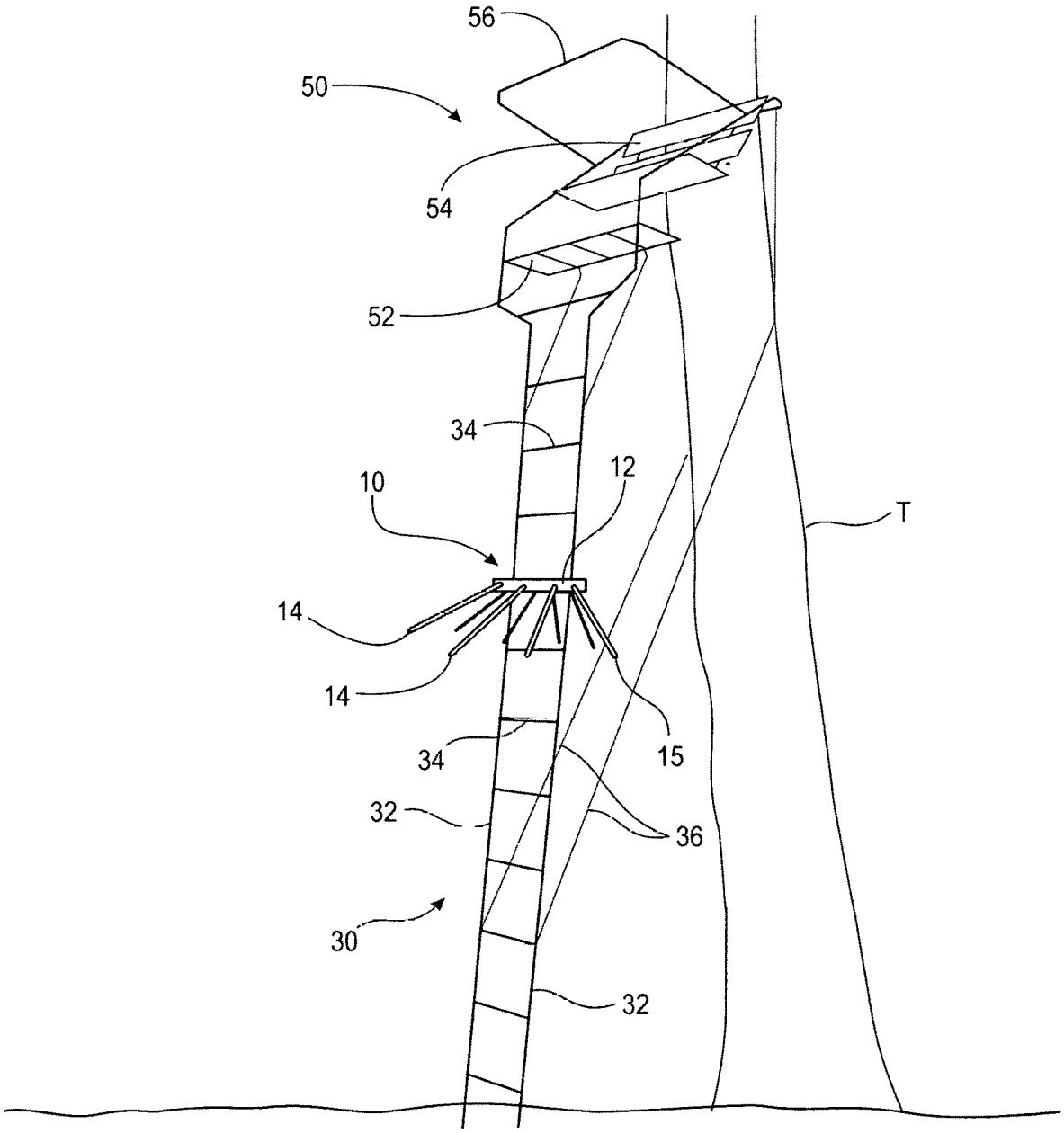
FIG. 6 is a side perspective view showing the blocking device of the present invention assembled with a ladder and blocking access to a tree stand in the field.

FIG. 6 is a side perspective view showing blocking device 10 assembled with ladder 30 blocking access to tree stand 50 in the field. Tree stand 50 is shown with hatch 52, seat 54, and roof 56. It can be seen that device 10 effectively blocks access to hatch 52 as the prongs 14 and 15 extending separately outwardly and downwardly from support 12 act to prevent a user from bypassing device 10. (Not shown is support 12*a* although prongs 14 can been extending separately and outwardly and downwardly between ladder 30 and tree T.) In this regard, prongs 14 and 15 can be any suitable length. In one embodiment, prongs 14 and 15 are at least 8 inches in length. In an alternate embodiment, prongs 14 and 15 are at least 13 inches in length.

FIG. 6 portrays the advantages of blocking device 10 over the prior art. Device 10 of the present invention can be placed higher up on ladders, creating a precarious situation for unauthorized users attempting to bypass the device. In addition, each support 12 and 12*a* is smaller and less cumbersome than an effective rung cover and thus easier to carry to the desired location, especially if that location is in a wilderness area. Moreover, the person attaching device 10 to ladder 30 can climb ladder 30 and attach it to the desired rung then lock it. In contrast, to extend a rung cover high enough on a ladder to be effective, a second ladder is necessary to raise the cover high enough to prevent a user from bypassing the rung cover after which the second ladder must be removed from the site.

Figure 7:
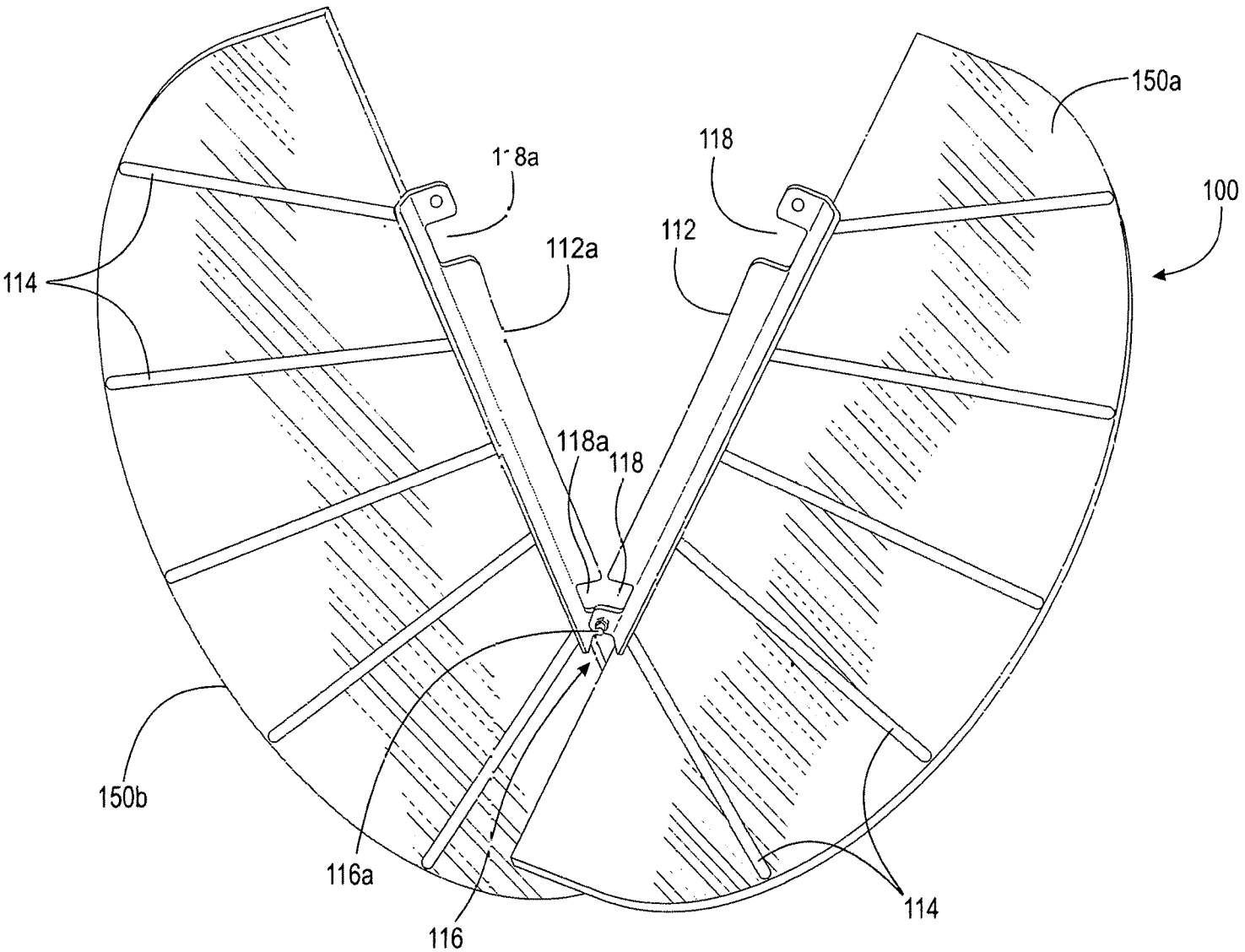
FIG. 7 is a bottom view of an alternate embodiment of the invention in which a shield is supported by the prongs.
Figure 8:
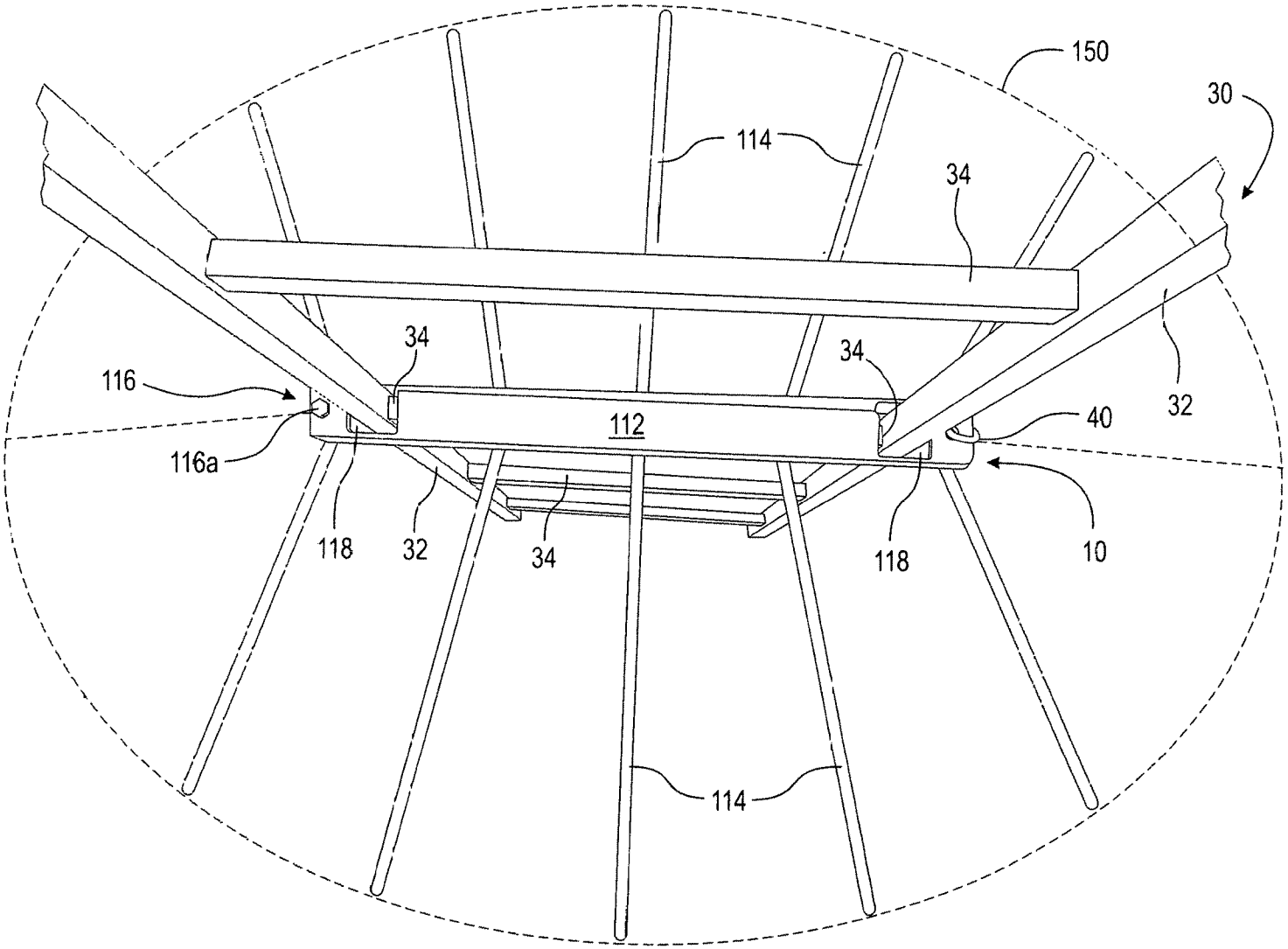
FIG. 8 is a top view depicting the shield of an alternate embodiment of the invention.

In a bottom view of an alternate embodiment, FIG. 7 depicts ladder blocking device 100 ("device 100") with a plurality of prongs 114 supporting shield 150. As seen in FIG. 7, shield 150 may be formed from two half shields, 150*a* and 150*b* that can be closed around pivot point 116 to form a complete shield 150. Half shields 150*a* and 150*b* do not have to be attached to each other to form an effective blocking shield as shown in FIG. 8 below. Device 100 may include first support 112 (support 112") which holds a plurality of prongs 114 that extend from first support 112 at an angle in relation to support 12. In an alternate embodiment, device 10 also comprises second support 112*a* ("support 112*a*") (collectively "supports 112"). Similar to support 12 seen in FIG. 1, support 112 and support 112*a* may be joined to form a single support 112. In the embodiment shown, the two components of support 112 may be pivotably joined at pivot point 116 forming a complete shield 150 that blocks both sides of ladder 30. In the drawing shown, bolt 116*a* forms the pivotable joint. In other embodiments, the pivotable joint may be a hinge or other joint well known to persons skilled in the art. Preferably, notches 118 and 118*a* are formed in supports 112 to enable each support 112 and 112*a* to fit around the stringers 32 of the blocked ladder 30 (not shown in FIG. 7). Supports 112 and 112*a* may be attached directly to ladder 30 such as by welding or bolting one or more of supports 112 to ladder 30 or indirectly such as by resting device 10 on a ladder rung while in a closed position with notches 118 and 118*a* fitted around the stringers of ladder 30.

Shield 150 may be fabricated from different material as long as it is durable and possesses sufficient strength to maintain structural integrity if people attempt to climb over it, cut it, or otherwise try to bypass it. Examples of appropriate fabrication materials include, but are not limited to steel, stainless steel, aluminum and some forms of carbon fiber reinforced polymer (CFRP). Persons of skill in the art will recognize that other suitable materials may be used to fabricate shield 150.

FIG. 8 is a top view depicting shield 150 (shown by the shaded line) of blocking device 100 attached to and supported by prongs 114. In this view, device 100 is attached to and supported by ladder 30. Device 100 is supported by one of the plurality of rungs 34 and extends to each of the two parallel stringers 32 of ladder 30. Notches 118 and 118*a* form combined notch 118 that fit around each stringer 32 to hold device 100 in position on ladder 30. Prongs 114 extend from support 112 and support 112*a* (not seen in FIG. 8) so that both sides of ladder 30 are blocked from an unauthorized user. Side prongs similar to prongs 15 may be included in device 100. Shield 150 may be attached to one or more of prongs 114 by using spot welds and certain adhesives and other methods known in the art can be used to form permanent attachments to prongs 114. Nut and bolt assemblies may be used.

Figure 9:
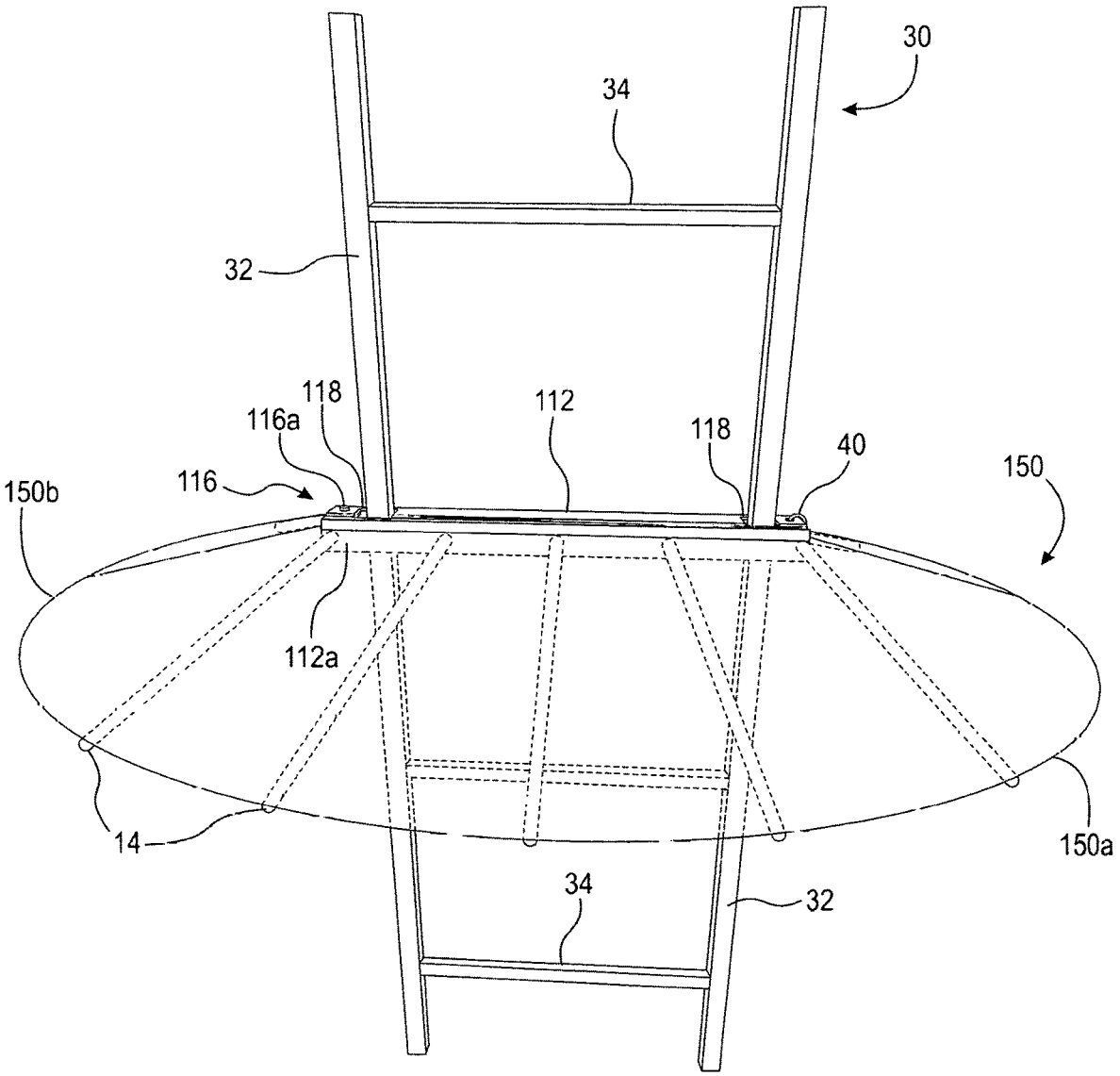
FIG. 9 is a front view of the blocking device of alternate embodiment attached to the ladder.

Although two supports 112 are shown in FIG. 8, persons having skill in the art will recognize that only a first support 112 with shield 150*a* may be needed to block use of ladder 30 if the ladder is positioned close to a building or other structure so that there is insufficient space for a user to climb up the unblocked side of ladder 30. FIG. 9 is a front view of blocking device 10 attached to ladder 30 and depicting the shield 150 extending downwardly and outwardly from supports 112 and 112*a*.

Figure 10:
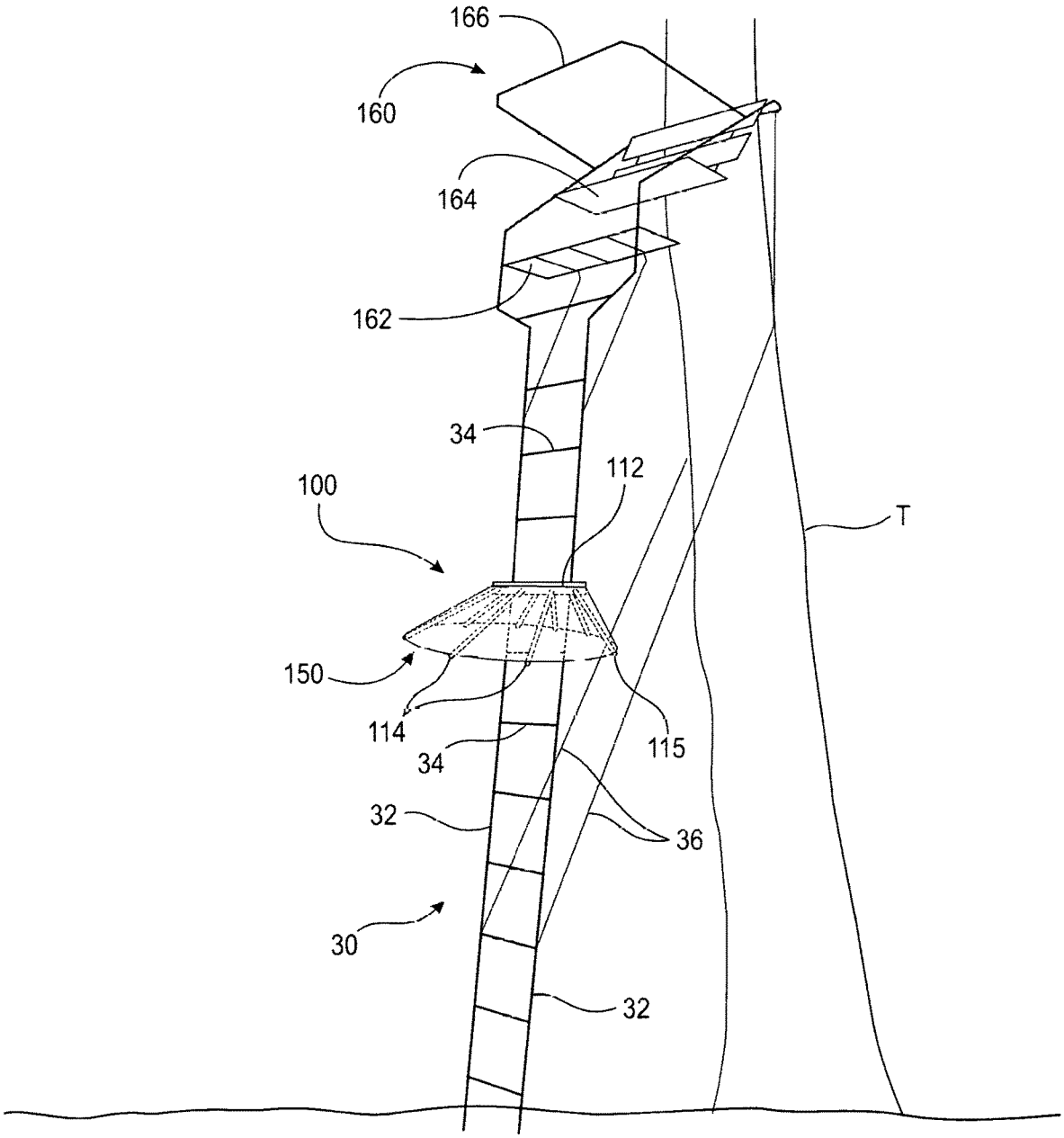
FIG. 10 is a side perspective view showing the blocking device of the alternate embodiment assembled with ladder and blocking access to a tree stand in the field; and, FIG. 11 is a top perspective view of a second alternate embodiment of the ladder blocking device with the prongs removed attached to and supported by a ladder.

FIG. 10 is a side perspective view showing blocking device 100 assembled with ladder 30 blocking access to tree stand 160 in the field. Tree stand 160 is shown with hatch 162, seat 164, and roof 166. It can be seen that shield 150 of device 100 effectively blocks access to hatch 162 as shield 150 acts to prevent a user from climbing around device 100. In one embodiment, prongs 114 and shield 150 are at least 8 inches in length. In an alternate embodiment, prongs 114 and 115 are at least 13 inches in length. In this regard, prongs 114 and side prongs 115 (if present) can be any suitable length to support shield 150 while shield 150 may extend farther than the length of prongs 114 and/or prongs 115*s*.

Figure 11:
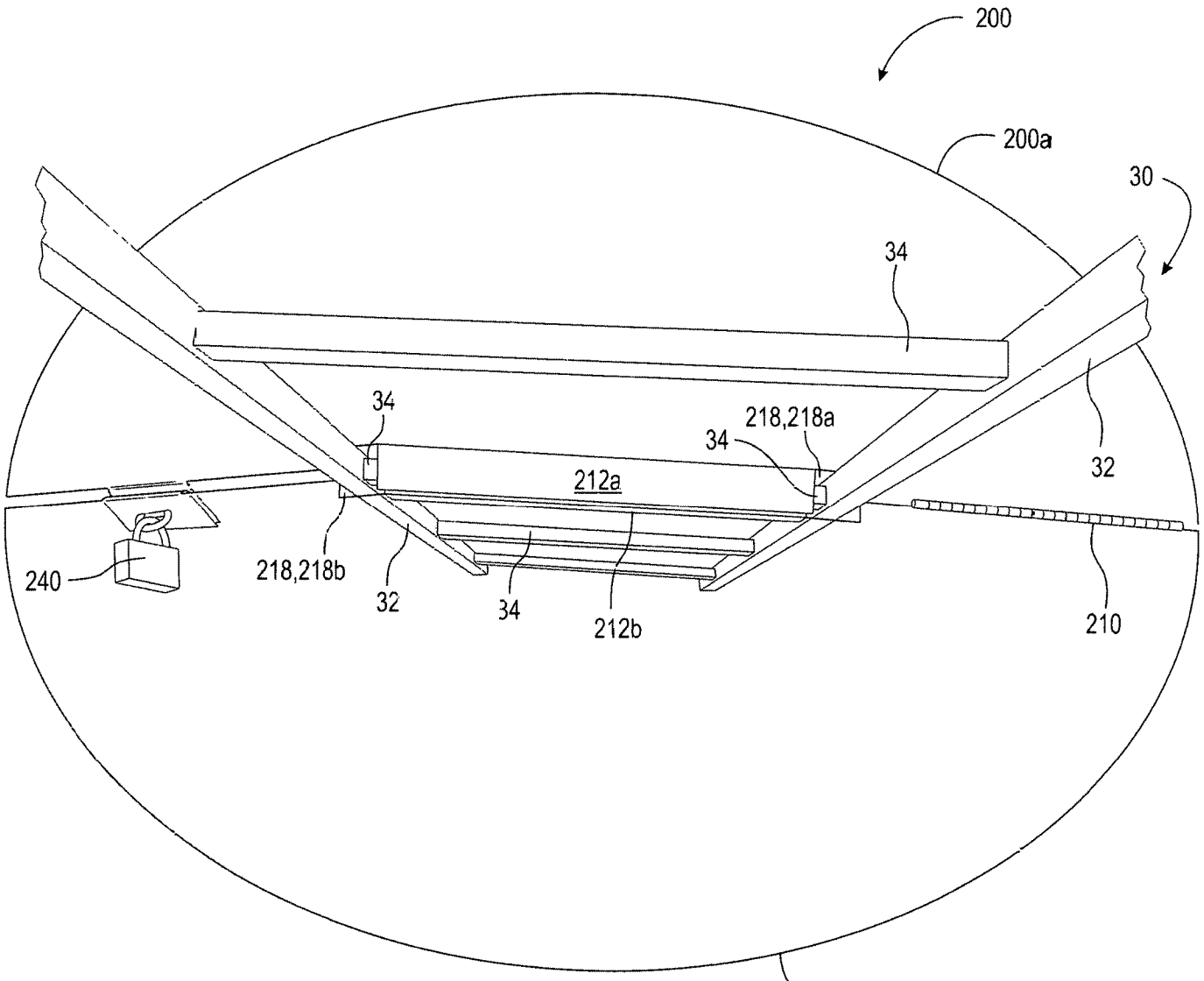

FIG. 11 is a top perspective view of still another embodiment of the invention in which ladder blocking device 200 ("device 200") is attached to a supported by ladder 30. It will be noted that device 200 does not include the plurality of prongs seen in devices 10 and 100. In other words, device 200 is supported by supports 212*a* and 212*b* to form support 212 which is analogous in structure and function to supports 12 and 112 discussed above. As indicated by pivot end 216 and locked end 240, device 200 comprises two halves 200*a* and 200*b* with attached supports 212*a* and 212*b*, respectively. When pivoted closed on hinge 210, supports 212*a* and 212*b* together form support unit 212 which rests on one of rungs 34 of ladder 30. In a preferred embodiment, each of supports 212*a* and 212*b* includes notches 218*a* and 218*b*, respectively which wrap around stringers 32 to releasably attach device 200 more securely to ladder 30.

Figure 12:
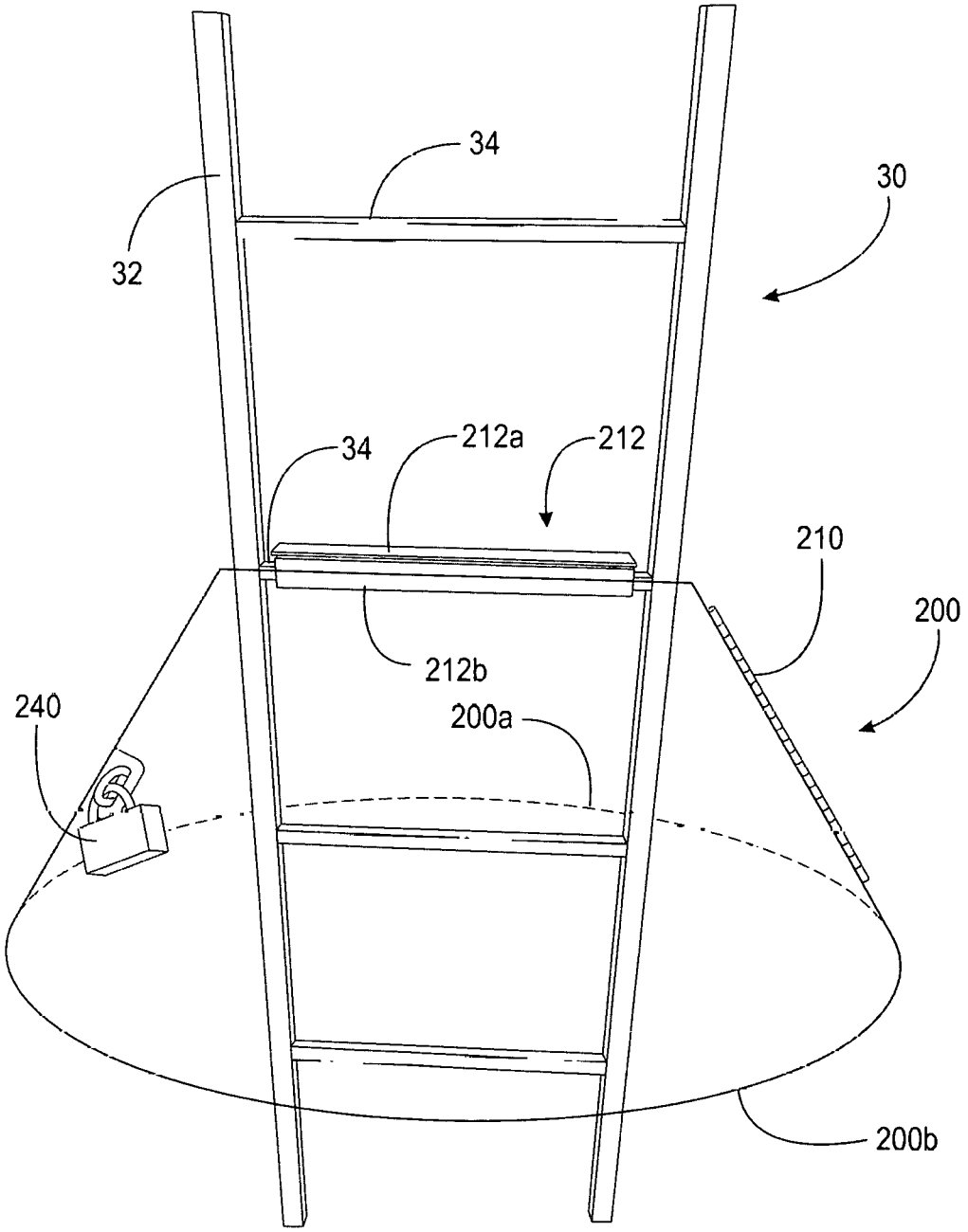
FIG. 12 is a front view of the embodiment seen in FIG. 11.

FIG. 12 is a bottom view of the embodiment seen in FIG. 11 again lacking the supportive prongs. More clearly seen in this view is hinge 210 which extends along the width of shield 200 to facilitate closing the two shield halves, 200*a* and 200*b*, respectively.

Figure 13:
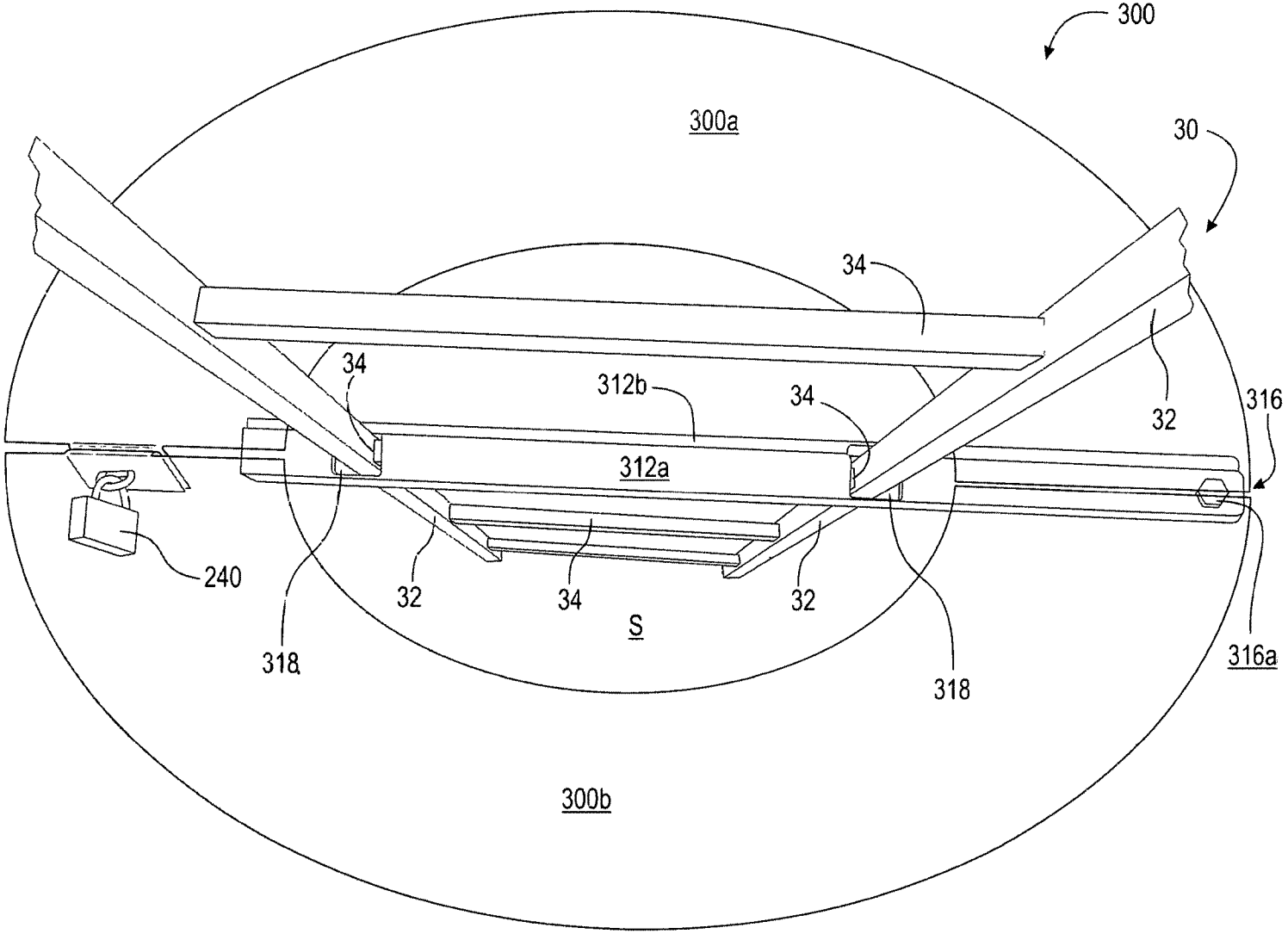
FIG. 13 is a top view of a third alternate embodiment of the ladder blocking device attached to and supported by a ladder.

FIG. 13 is a top view of a third alternate embodiment of the ladder blocking device seen supported by ladder 30. Ladder blocking device 300 ("device 300") is a modification of the d-ring discussed above. Device 300 comprises two d-ring shaped shields 300*a* and 300*b*, respectively. The straight edges of the shields each are shaped into supports 312*a* and 312*b*, respectively, joined at pivot point 316 joined by pivot bolt 316*a*. When the two shields are closed support 312 is formed by supports 312*a* and 312*b* and is supported by one of rungs 34 on ladder 30. Hasp 340 holds device 300 closed on the side opposite pivot point 313. Notches 318 wrap around stringers 32 to hold device 300 in place.

In the embodiment depicted in FIG. 13, support 312 extends outside each of ladder stringers 32 with shields 300*a* and 300*b* attached to respective supports 312*a* and 312*b*. This configuration creates a space S between rung 34 and each of the inner edges of the semicircular d-ring shaped shields 300*a* and 300*b*. Device 300 may be manufactured from the same or similar material discussed above and has the advantage of weighing less than blocking devices fabricated from similar material thus making it easier to handle. Shields 300*a* and 300*b* may extend horizontally, at a downward angle, or at an upward angle from supports 312*a* and 312*b*, respectively.

Thus it is seen that the objects of the invention are efficiently obtained, although changes and modifications to the invention should be readily apparent to those having ordinary skill in the art, which changes would not depart from the spirit and scope of the invention as claimed.

I claim:

1. A ladder blocking device comprising:

a first support wherein said first support ranges at least from a first stringer of said ladder to at least a second stringer of said ladder;

a first shield fixedly attached to said first support;

a second shield fixedly attached to a second support, wherein said second support ranges from said first stringer to said second stringer; and, an attachment means to attach said first support and said second support to said ladder;

wherein said first support is connected to said second support to form a shield unit;

wherein said first support and said second support both are shaped to be supported by an identical rung of said ladder; and, wherein said first support is pivotably connected directly to said second support.

2. The ladder blocking device of claim 1 further comprising a locking means to lock said first support to said second support.

3. The ladder blocking device of claim 1 wherein at least one of said first shield and first support and said second shield and said second support form a generally D shape opening.

4. The ladder blocking device of claim 1 wherein each of said first and second support includes at least one notch sized to fit around a stringer of said ladder.

5. The ladder blocking device of claim 1 wherein at least one of said first shield and second shield is at least 8 inches long.

6. The ladder blocking device of claim 1 wherein at least one of said first shield and second shield is at least 13 inches long.

7. The ladder blocking device of claim 1 further comprising a first plurality of prongs, each one of said first plurality of prongs separately extending downwardly and outwardly from said first support and fixedly attached to said first shield.

8. The ladder blocking device of claim 7 further comprising a second plurality of prongs, each one of said second plurality of prongs separately extending downwardly and outwardly from said second support and fixedly attached to said second shield.

9. The ladder blocking device of claim 7 wherein at least one of said first plurality of prongs and second plurality of prongs is at least 8 inches long.

10. The ladder blocking device of claim 9 wherein at least one of said first plurality of prongs and second plurality of prongs is at least 13 inches long.

11. A ladder blocking device comprising:

a first support wherein said first support ranges at least from a first stringer of said ladder to at least a second stringer of said ladder;

a first plurality of prongs, each one of said first plurality of prongs extending separately downwardly and outwardly from said first support;

a second support wherein said second support ranges from said first stringer to said second stringer;

a second plurality of prongs, each one of said second plurality of prongs extending separately downwardly and outwardly from said second support; and, an attachment means to attach said first support and said second support to said ladder;

wherein said first support is connected to said second support;

wherein said first support and said second support overlap each other and both said first support and said second support are supported by an identical rung of said ladder; and, wherein said first support is pivotably connected directly to said second support.

12. The ladder blocking device of claim 11 further comprising a locking means to lock said first support to said second support.

13. The ladder blocking device of claim 11 further comprising at least one side prong extending away from at least one of said first stringer and said second stringer.

14. The ladder blocking device of claim 11 wherein at least one of said first plurality of prongs and/or said second plurality of prongs extends in a downward and outward direction.

15. The ladder blocking device of claim 11 wherein each of said first and second support includes at least one notch sized to fit around a stringer of said ladder.

16. The ladder blocking device of claim 11 wherein at least one of said first plurality of prongs is at least 8 inches in length and at least one of said second plurality of prongs is at least 8 inches in length.

17. The ladder blocking device of claim 16 wherein at least one of said first plurality of prongs is at least 13 inches in length and at least one of said second plurality of prongs is at least 13 inches in length.

18. A ladder assembly comprising:

a ladder including a pair of stringers and a plurality of rungs extending between and fixedly attached to each one of said pair of stringers, said pair of stringers arranged in a parallel manner; and, a ladder blocking device including:

a support assembly wherein a first blocking support and a second blocking support each range at least from a first stringer of said ladder to at least a second stringer of said ladder; and, an attachment means to attach said support assembly to said ladder;

wherein said first blocking support and said second blocking support overlap each other and rest on are supported by an identical rung of said ladder; and, wherein said first support is pivotably connected directly to said second support.

19. The ladder assembly of claim 18 further comprising a locking means to lock said first support to said second support.

20. The ladder assembly of claim 18 further comprising a first shield fixedly attached to said first blocking support and a second shield fixedly attached to said second blocking support;

wherein said first shield and said second shield both extend outwardly and downwardly from said first support and said second support, respectively.

21. The ladder assembly of claim 18 further comprising a first plurality of prongs each one of said plurality of prongs is separately attached to said first blocking support and a second plurality of prongs each one of said plurality of prongs is separately attached to said second blocking support;

wherein each one of said first plurality of prongs and each one of said second plurality of prongs extend outwardly and downwardly from said first support and said second support, respectively.

22. The ladder assembly of claim 21 wherein said first plurality of prongs supports a first shield and said second plurality of prongs supports a second shield.

23. A ladder blocking device comprising:

a support wherein said support ranges at least from a first stringer of a ladder to at least a second stringer of said ladder;

a blocking element fixedly extending at downwardly and outwardly from said support and extending from said first stringer to said second stringer;

wherein said support is a first support and a second support both are shaped to be supported by an identical rung of said ladder; and wherein said first support is pivotably connected directly to said second support.

24. The ladder blocking device of claim 23 wherein said blocking element is a plurality of prongs wherein each one of said plurality of prongs is separately attached to said support.

25. The ladder blocking device of claim 23 wherein said blocking element is a shield.

26. The ladder blocking device of claim 23 wherein said blocking element is a shield supported by a plurality of prongs wherein each of said plurality of prongs are separately attached to said support.

* * * * *